US005252377A

United States Patent [19]

Pöll

[11] Patent Number: 5,252,377

[45] Date of Patent: Oct. 12, 1993

[54] MAGAZINE STRIP FOR GEMS

[75] Inventor: Martin Pöll, Fritzens, Austria

[73] Assignee: D. Swarovski & Co., Wattens, Austria

[21] Appl. No.: 882,077

[22] Filed: May 12, 1992

[30] Foreign Application Priority Data

May 23, 1991 [DE] Fed. Rep. of Germany ..... 4116866

[51] Int. Cl.[5] ..... B32B 3/10; B32B 3/28; B65D 73/00; B65D 6/04

[52] U.S. Cl. ..... 428/137; 428/138; 428/167; 428/913.3; 206/486; 206/566

[58] Field of Search ..... 428/137, 138, 167, 913.3; 206/486, 566

[56] References Cited

U.S. PATENT DOCUMENTS 4,181,224 1/1980 Aber ..... 206/486
4,718,554 12/1988 Barbato ..... 206/477
4,821,883 4/1989 Miller ..... 206/486
5,056,656 10/1991 Pöll ..... 428/167

FOREIGN PATENT DOCUMENTS 837212 4/1976 Belgium .
961454 1/1975 Canada ..... 219/1
3143604 5/1983 Fed. Rep. of Germany .
2098604 3/1972 France .

*Primary Examiner*—George F. Lesmes
*Assistant Examiner*—Kathryne E. Shelborne
*Attorney, Agent, or Firm*—Fish & Richardson

[57] ABSTRACT

The invention relates to a magazine strip for gems. The magazine strip has a sandwich structure, comprising in particular a middle soft layer, a reversibly deformable layer disposed thereabove and optionally a reversibly deformable layer disposed under the middle layer. The magazine strip has at least in its upper layer holes into which the gems can be pressed and out of which they can be pressed with equal ease.

9 Claims, 1 Drawing Sheet

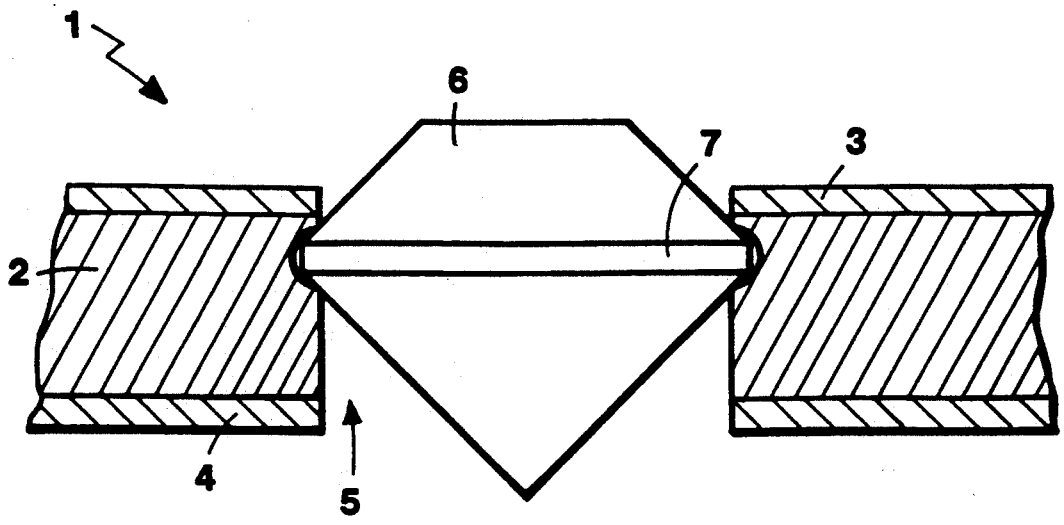
1
6
7
3
2
4
5

MAGAZINE STRIP FOR GEMS

The present invention relates to a magazine strip for gems.

Gems of all types are used today for a great variety of decorative purposes and handled by automatic machines. There is therefore a need for magazined gems. The gems should always be protected against excessive mechanical stress, and at the same time their handling, i.e. their use, simplified.

The prior art already discloses a magazine strip in which the gems can be positioned well and out of which the gems can also be easily removed by an automatic machine. German "offenlegungsschrift" no. 39 12 336 describes a magazine strip comprising a plastic film having depressions for taking up the gems and holding lips for holding them. However the production of such a magazine strip is relatively elaborate and its use is furthermore always limited to a certain shape of gem, either chatons or roses.

The present invention is based on the problem of providing a simple magazine strip for gems in which the gems can be mounted in easily removable fashion. In particular the gems are to be accessible for automated handling.

The invention is based on the finding that this problem can be solved by a magazine strip having a suitable sandwich structure.

The object of the invention is a magazine strip for gems which is characterized in that the magazine strip is composed of a soft layer, a reversibly deformable layer disposed thereabove and, optionally, a reversibly deformable layer disposed under the soft layer, the magazine strip having at least in its upper layer holes into which the gems can be pressed and which have a smaller diameter than the corresponding gems.

The magazine strip of the present invention is particularly easy to produce and to handle. Due to the inside softer layer the gems can be mounted with shock absorption and free from chafing. When the gems are pressed into the magazine strip from above they are sunk and held with their equators in the soft material and prevented from creeping out of the magazine by the reversibly deformable layer. If the soft layer is provided with a reversibly deformable layer on both sides the stones are optimally prevented from creeping out. For use the gems need only be pressed downward out of the magazine strip. They can of course also be pressed out upwardly if this is desirable for the work technique used.

Preferred embodiments of the present invention are found in the subclaims.

It is preferable to use for the middle layer a relatively soft material, e.g. usual commercial foamed material. All flexible foamed materials are suitable if they have low deformation resistance and high elastic plasticity. This firstly has the advantage that the bases of the gems are mounted with particular softness and shock absorption and, secondly, it makes it substantially easier to press the gems into the magazine strip and press them out again for use.

The outer layer or layers preferably consist of suitable plastic films, e.g. of polyester. The most important property of these films is that they must give well when the gems are pressed into the magazine strip but return more or less to their initial position as soon as the gems are completely pressed in. Only then is a reliable hold of the gems in the magazine strip ensured. However one can also use an elastic layer of lacquer applied for example to soft cardboard. Paper layers can also be used.

It is suitable and preferable to adapt the holes to the equators of the gems used.

In the following the invention shall be explained with reference to a schematic representation.

The single figure shows a cross section through a preferred embodiment of the inventive magazine strip. The magazine strip, which bears reference number 1, is composed of a layer 2, an upper layer 3 and a lower layer 4. Gem 6 is pressed into a hole 5 in magazine strip 1 so that its equator 7 is mounted below upper layer 3. When gem 6 is pressed in, upper layer 3 snaps over its equator 7. The drawing also indicates that it is an essential feature of the inventive magazine strip that holes 5 have a smaller diameter than gems 6. The tip of gem 6 penetrates lower layer 4. Middle soft layer 2 can also have a thickness which takes up the total lower part of the gem. In this case one can possibly omit the lower reversibly deformable layer.

Gem 6 is pressed from above through upper layer 3 into the magazine strip until its equator has penetrated into layer 2. Upper layer 3, which is made of a reversibly deformable material, returns to its initial position after the insertion of gem 6, so that gem 6 is held in the magazine strip. For use of gem 6 it can be pressed through lower layer 4 from above. To give the magazine strip high stability and gem 6 an additional hold it is expedient to make lower layer 4 of a reversibly deformable material as well. Layers 3 and 4 should in any case be stronger than soft layer 2.

The materials to be used for layer 2 are particularly all soft types of foamed material which have a particularly low deformation resistance but high elastic plasticity. However one can also use large-pored papier-mâché for this layer 2. The two outer layers should in any case be made of a stronger material than first inner layer 2. But they must likewise be deformable and elastic. It is expedient to use suitable plastic films, e.g. polyester film; it is also conceivable to apply an elastic layer of lacquer, in particular if inner layer 2 is made of large-pored papier-mâché. Particularly suitable sandwich combinations are ones in which the softer layer is made of cardboard box or Moltopren and the outer stronger layer or layers are formed by adhesive film. Styrofoam is also suitable as the softer layer. In any case one must select a material which can be easily bent or even rolled up.

The inventive magazine strips are suitable for taking up gems with a size of 1 to 5 mm. The thickness of the sandwich laminate is between 0.8 and 5 mm depending on the size of the gems. The diameter of the holes should be about 5 to 20%, preferably 10%, smaller than the equator diameter of the gems.

The holes can either be through holes or be provided only in the upper reversibly deformable layer. They can be prestamped in the sandwich magazine. It is also conceivable to provide the holes first in the material of the upper layer and then laminate the latter onto the middle soft layer. One can also apply the upper reversibly deformable layer to the soft layer by means of screen printing and thereby produce the holes. It is in any case favorable for automatic use of the magazine strips if the holes are provided on the magazine strip at regular intervals.

The present invention provides a simple magazine strip for gems.

I claim:

1. A magazine strip for holding gems in combination with a plurality of gems each having a major diameter, said magazine comprising:

a soft layer, and a reversibly deformable upper layer disposed above said soft layer, at least said reversibly deformable upper layer of said magazine strip defining apertures sized to receive said gems pressed therethrough into the soft layer, each said aperture having a smaller diameter than a major diameter of a corresponding gem, and material of said reversibly deformable upper layer about said aperture being adapted to deflect in a manner to permit the major diameter of each gem pressed into a corresponding aperture to pass through said reversibly deformable upper layer, thereby to allow said gem to be inserted into said magazine strip, and, upon passage of the major diameter of the gem through said reversibly deformable upper layer, said material of said reversibly deformable upper layer being further adapted to return to initial position, with said material extending over at least a portion of the major diameter of said gem, thereby, in cooperation with said soft layer, to retain the gem in said magazine strip in cushioning fashion.

2. The magazine strip of claim 1 wherein said soft layer is made of a soft compressible material.

3. The magazine strip of claim 1 or 2 wherein said reversibly deformable upper layer is made of plastic film.

4. The magazine strip of claim 1 or 2 wherein said reversibly deformable upper layer is a layer of lacquer.

5. The magazine strip of claim 1 or 2 wherein said apertures are adapted to correspond to the equator shape of the gems.

6. The magazine strip of claim 1 further comprising a second reversibly deformable lower layer disposed under said the soft layer.

7. The magazine strip of claim 6 wherein said second reversibly deformable lower layer is made of plastic film.

8. The magazine of claim 6 wherein said second reversibly deformable lower layer is a layer of lacquer.

9. The magazine of claim 2 wherein the relatively soft material foamy said soft layer is a foamed material.

* * * * *